US006308897B1

(12) United States Patent
Remington et al.

(10) Patent No.: US 6,308,897 B1
(45) Date of Patent: Oct. 30, 2001

(54) LATERAL AND VERTICAL RAIL BRACE ASSEMBLY

(76) Inventors: James A. Remington, 1328 Lakeview Dr., Schererville, IN (US) 46375; Daniel A. Ivanyo, 6789 Pennsylvania St., Merrillville, IN (US) 46410; Dennis Wright, 3142 Helfred Ave., South Chicago Heights, IL (US) 60411

( * ) Notice: Subject to any disclaimer, the term of this patent is extended or adjusted under 35 U.S.C. 154(b) by 0 days.

(21) Appl. No.: 09/548,029

(22) Filed: Apr. 12, 2000

(51) Int. Cl.[7] ..... E01B 9/60

(52) U.S. Cl. ..... 238/292; 238/347; 238/310; 238/321; 238/336; 238/349

(58) Field of Search ..... 238/347, 292, 238/310, 321, 323, 336, 333, 331, 349, 351, 359, 361

(56) References Cited

U.S. PATENT DOCUMENTS

| | | | | |
|---|---|---|---|---|
| 4,566,630 | * | 1/1986 | Keiper | 238/292 |
| 4,770,342 | * | 9/1988 | Farrell et al. | 382/347 |
| 4,824,015 | * | 4/1989 | Farrell et al. | 238/336 |
| 5,104,041 | * | 4/1992 | Remington | 238/292 |

OTHER PUBLICATIONS

Drawing sheet entitled "Double Pandrol Shoulder". Four drawing sheets marked "¼" to "⁴⁄₄".

* cited by examiner

*Primary Examiner*—S. Joseph Morano
*Assistant Examiner*—Frantz F. Jules

(57) ABSTRACT

A rail brace assembly for bracing a rail with respect to a tie plate. The rail brace assembly includes a brace member, a locking member, a retention member and a spring clip fastener. The brace member has a top surface adapted to engage a head fishing surface of the rail, a bottom surface adapted to engage a base fishing surface of the rail, a front friction surface and an outwardly extending toe. The retention member is adapted to be attached to the tie plate and includes a bore adapted to receive a first end of the fastener and a recess adapted to receive the toe of the brace member to thereby prevent vertical movement of the brace member and the rail. The locking member has a front surface, a rear friction surface adapted to engage the front friction surface of the brace member, and a pair of spaced apart outwardly extending legs which straddle the retention member. A first end of the fastener is inserted into the bore of the retention member and a second end of the fastener biases the rear friction surface of the locking member into interlocking engagement with the front friction surface of the brace member to thereby inhibit lateral movement of the brace member with respect to the locking member.

39 Claims, 7 Drawing Sheets

LATERAL AND VERTICAL RAIL BRACE ASSEMBLY

BACKGROUND OF THE INVENTION

The present invention is directed to a rail brace assembly for bracing and securing a rail to a tie plate, and in particular to a rail brace assembly including a brace member which braces the rail against lateral, rotational and vertical movement.

Rail braces are used to brace or buttress railroad rails against side thrust forces exerted by the wheels of rail traffic that would rotate or overturn the rail if not resisted. Side thrust forces of a magnitude sufficient to overturn a rail most commonly occur at curved sections of the rail which are subjected to high speed rail traffic. Rail braces typically utilize nuts and bolts, or resilient spring clips, for securing a brace to the tie plate and for applying a horizontal restraining force to the rail. The use of nuts and bolts presents a problem in that threads can be stripped, nuts can become loose, alignment of bolts in bolt holes can be difficult and time consuming, and wrenches are required for installation. Current boltless braces utilizing spring clips do not provide for vertical retention of the rail other than by the biasing force that is provided by the spring clip itself. As a result, when current boltless braces are utilized a rail can be pulled out of its rail seat during handling, and especially during tamping. The present invention overcomes these problems.

SUMMARY OF THE INVENTION

A rail brace assembly for bracing a rail that is located in the seat of a tie plate and for securing the rail to the tie plate. The rail includes a head fishing surface and a base fishing surface. The rail brace assembly includes a brace member having a top surface adapted to engage the head fishing surface of the rail, a bottom surface adapted to engage the base fishing surface of the rail, a front friction surface including a plurality of elongate ridges that form a corrugated surface, and an outwardly extending toe having an upper surface and an angled side surface. The rail brace assembly also includes a locking member having a front surface, a rear friction surface having a plurality of spaced apart ridges which form a corrugated surface that is adapted to engage the front friction surface of the brace member, and first and second spaced apart outwardly extending legs. The rail brace assembly also includes a retention member adapted to be attached to the tie plate that includes a bore and a recess adapted to receive the toe of the brace member. The legs of the locking member arc adapted to be located on opposite sides of the retention member to substantially prevent lateral movement of the locking member. The rail brace assembly also includes a resilient spring-clip fastener having a first end adapted to be inserted into the bore of the retention member and a second end adapted to engage the front surface of the locking member such that the fastener resiliently biases the rear friction surface of the locking member into interlocking engagement with the front friction surface of the brace member to thereby inhibit lateral movement of the brace member. The engagement of the top surface and of the bottom surface of the brace member with the rail inhibits transverse and rotational movement of the rail. The insertion of the toe of the brace member into the recess of the retention member enables the retention member to inhibit vertical movement of the brace member and of the rail. The retention member includes a stop member in communication with the bore to limit how far the first end of the fastener can be inserted into the bore of the retention member.

BRIEF DESCRIPTION OF THE DRAWING FIGURES

DETAILED DESCRIPTION OF THE PREFERRED EMBODIMENT

Figure 1:
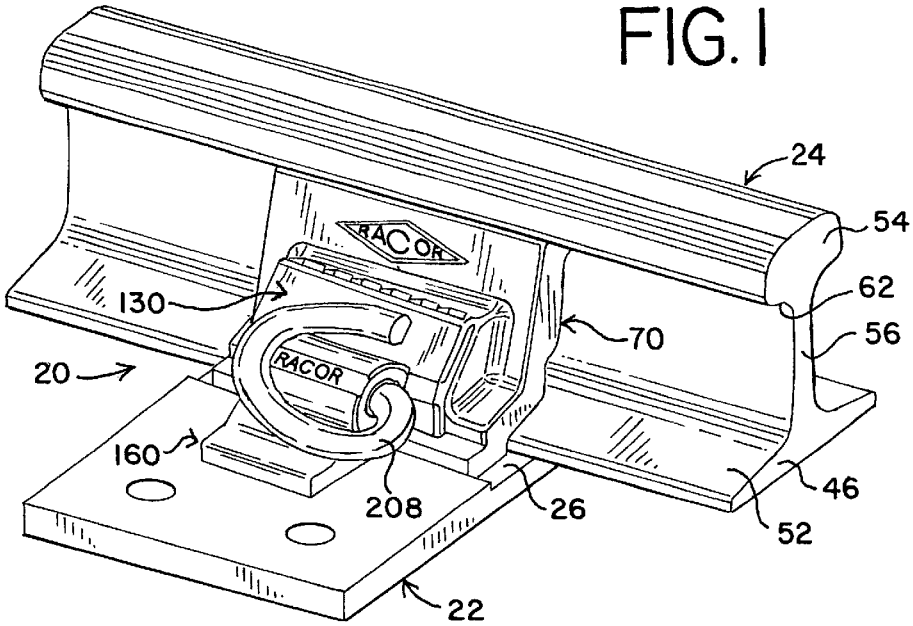
FIG. 1 is a perspective view of the rail brace assembly shown in connection with a tie plate and a rail.
Figure 2:
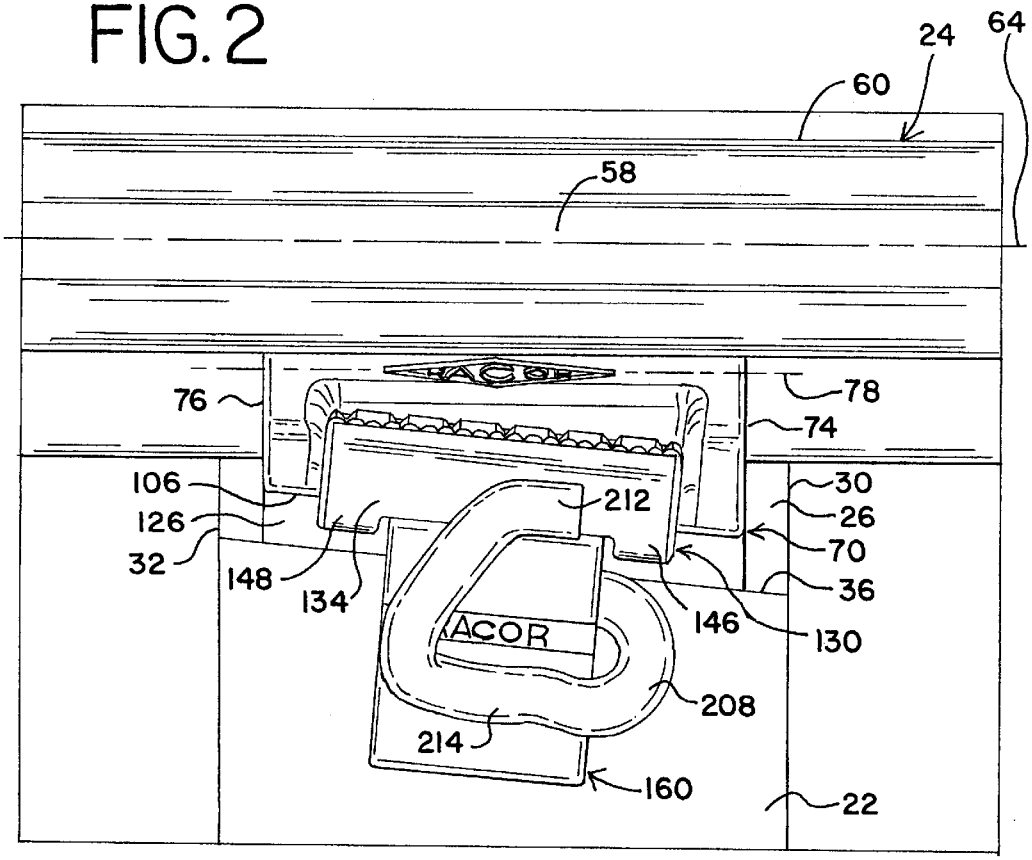
FIG. 2 is a top plan view of the rail brace assembly shown in connection with the tie plate and rail.
Figure 3:
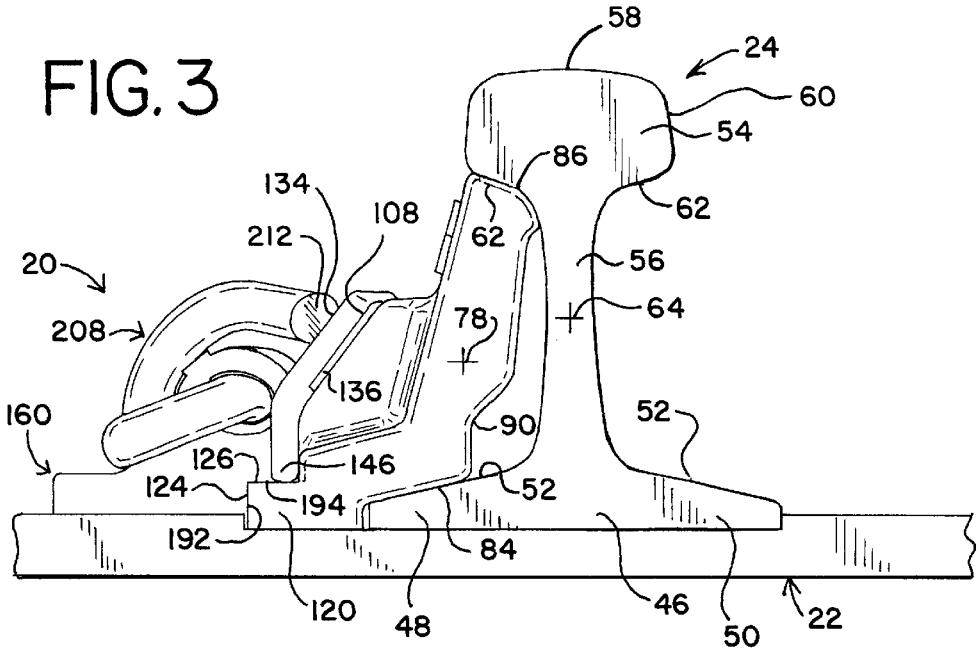
FIG. 3 is a side view of the rail brace assembly shown in connection with the tie plate and rail.
Figure 4:
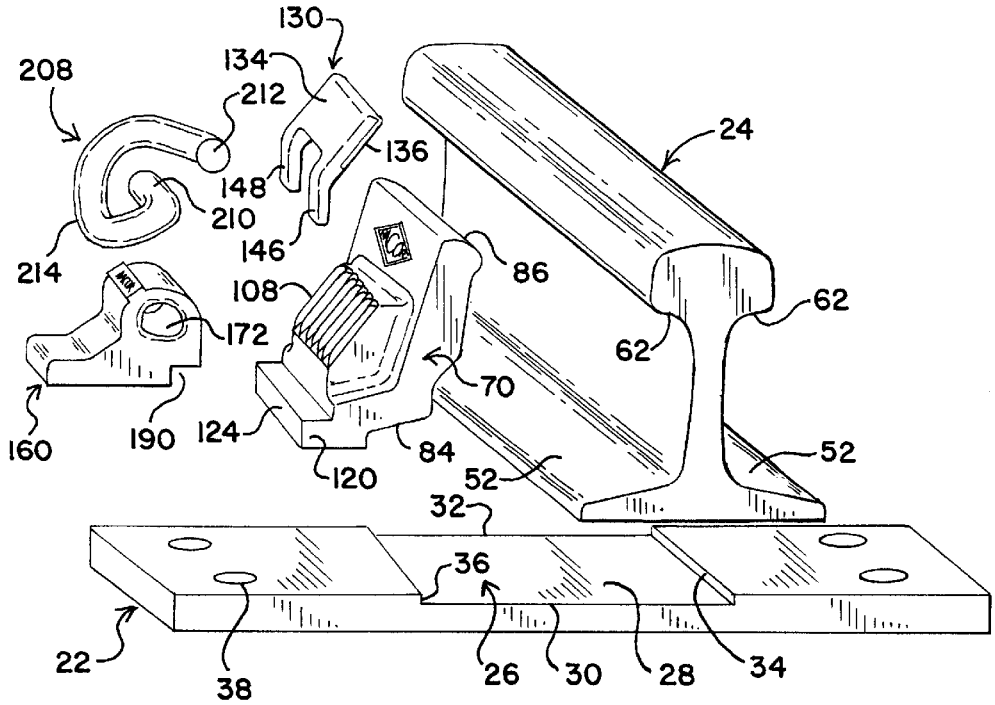
FIG. 4 is an exploded view of the rail brace assembly shown in connection with the tie plate and rail.

The rail brace assembly 20 of the present invention is shown in FIGS. 1–4 in connection with a tie plate 22 and a rail 24. The tie plate 22 as best shown in FIG. 4 includes a rail seat 26 formed in the top surface of the tie plate 22. The seat 26 is generally channel-shaped and includes a planar bottom wall 28 having a first generally linear edge 30 and a second generally linear edge 32. The edges 30 and 32 are spaced apart and generally parallel to one another. The seat 26 also includes a first side wall 34 which is generally planar and which extends generally vertically upwardly from the bottom wall 28. The side wall 34 extends between, and generally perpendicular to, the edges 30 and 32. The seat 26 also includes an angled side wall 36 which is generally planar and which extends generally vertically upwardly from the bottom wall 28. The angled side wall 36 extends between the edges 30 and 32. The angled side wall 36 is disposed at a horizontal angle to the side wall 34, such as at an angle of approximately 4.8°. The tie plate 22 also includes a plurality of apertures 38 through which spikes can be driven into ties. The end of the angled side wall 36 which is at the first edge 30 of the bottom wall 28 is spaced apart farther from the side wall 34 than is the end of the angled side wall 36 that is located at the second edge 32 of the bottom wall 28.

The rail 24, as best shown in FIG. 3 includes a base 46 that is adapted to be located on the bottom wall 28 of the rail seat 26 of the tie plate 22. The base 46 includes a first flange 48 and a second flange 50. Each flange 48 and 50 includes an inclined upper surface which is a base fishing surface 52. The rail 24 also includes a head 54 which is connected to the base 46 by a vertical web 56. The head 54 includes a top surface 58 that is adapted to engage the treads of railroad car and locomotive wheels. The head 54 also includes a vertical side surface 60 which is adapted to contact the flanges on the wheels of railroad cars and locomotives and which receives lateral forces therefrom. The head 54 also includes an inclined lower surface on each side of the web 56 which is a head fishing surface 62. The rail 24 includes a central longitudinal axis 64. As best shown in FIG. 3, the base 46 of the rail 24 is located within the rail seat 26 such that the base 46 is in engagement with the bottom wall 28 and the second flange 50 is in abutting engagement with the side wall 34 of the seat 26.

Figure 5:
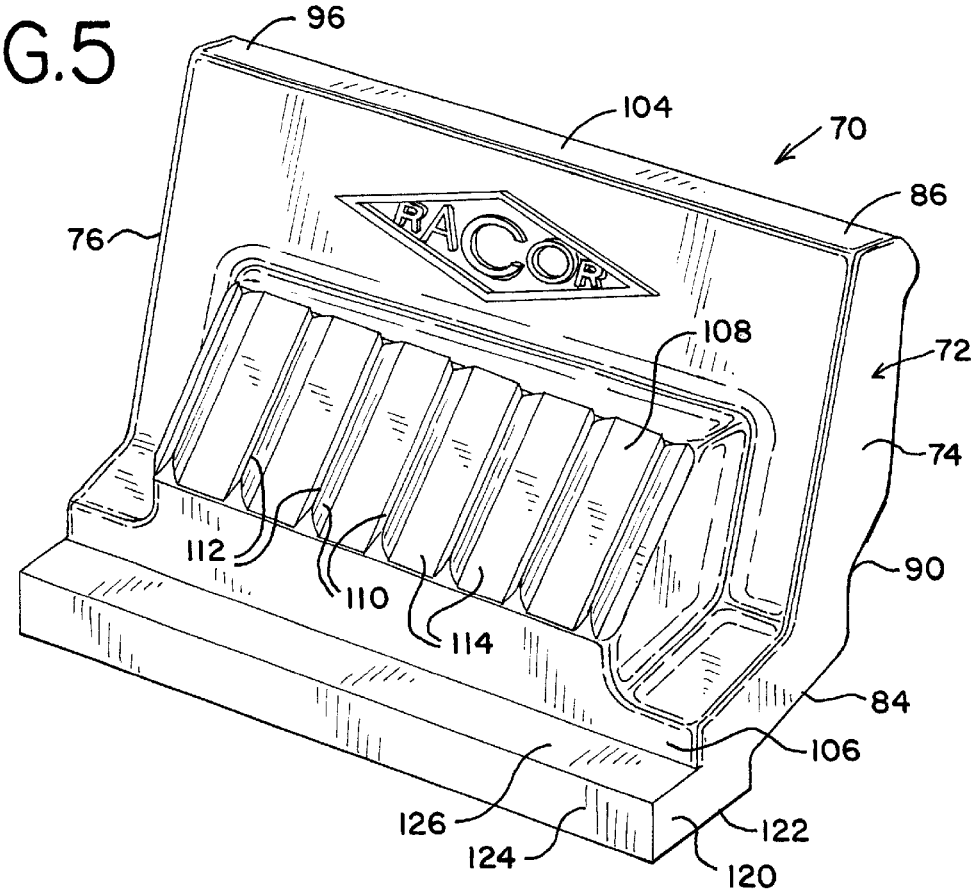
FIG. 5 is a perspective view of the brace member of the rail brace assembly.
Figure 6:
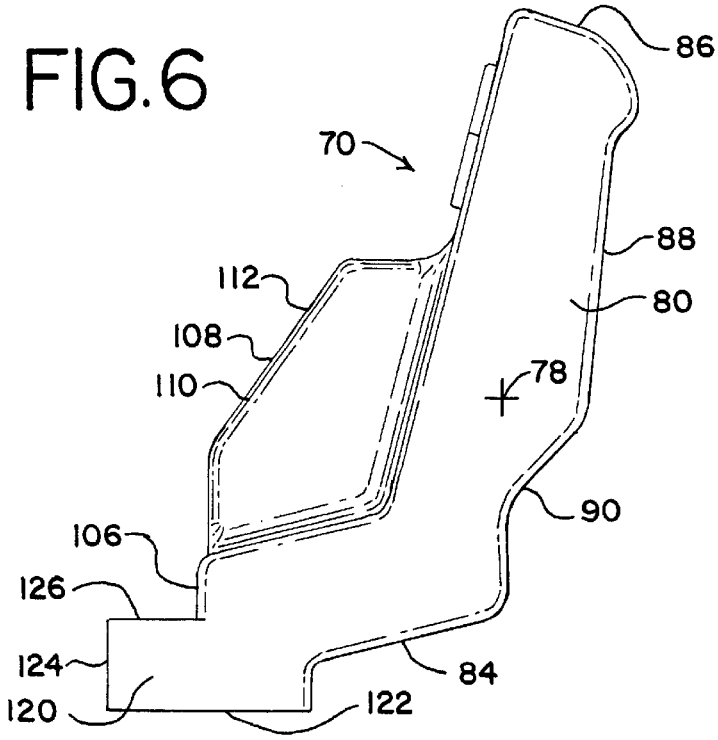
FIG. 6 is a side view of the brace member.
Figure 7:
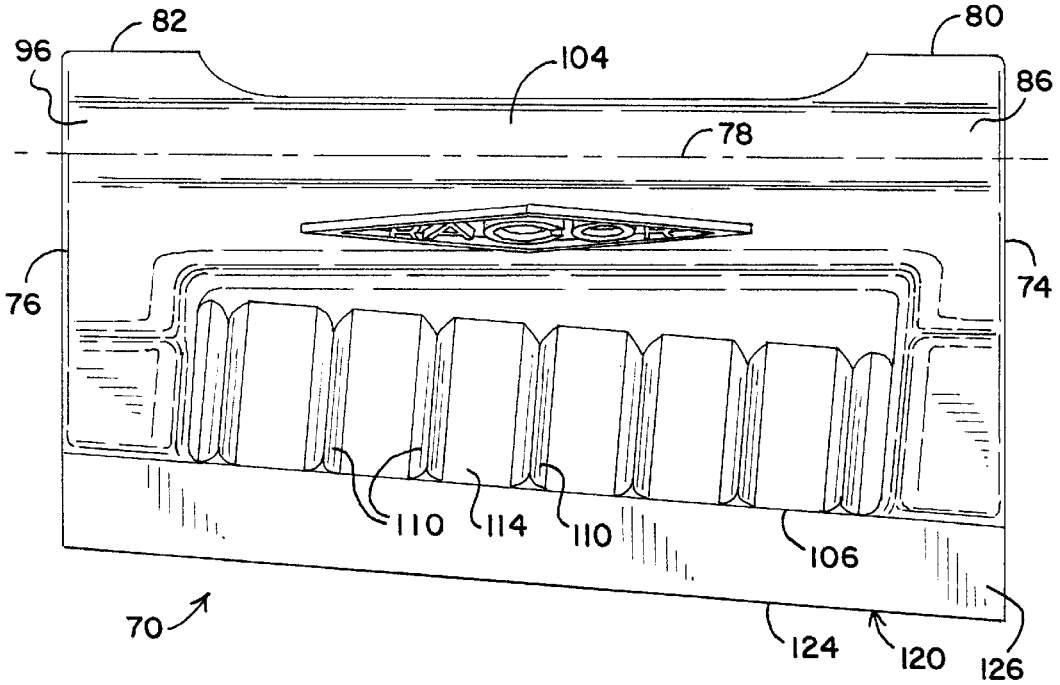
FIG. 7 is a top plan view of the brace member.
Figure 8:
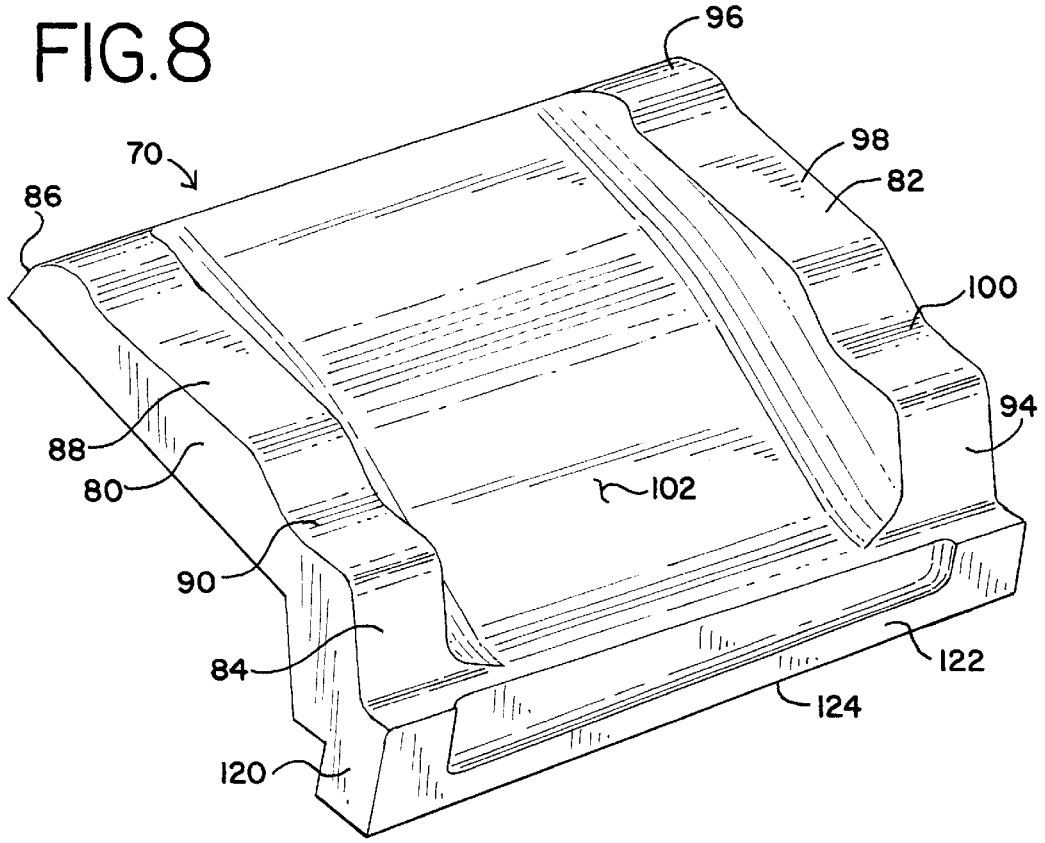
FIG. 8 is a rear perspective view of the brace member.

The rail brace assembly 20 includes a brace member 70. The brace member 70 includes a body 72 as best shown in FIG. 5, which has a first end 74 and a second end 76. The body 72 includes a linear longitudinal axis 78 which extends from the first end 74 to the second end 76. The axis 78 is adapted to be disposed generally parallel to the central axis 64 of the rail 24. or if the rail 24 and its central axis 64 are curved the axis 78 is adapted to be generally equally spaced from the central axis 64 at each end of the brace member 70. As best shown in FIG. 8, the base member 70 includes a first vertical rib 80 and a spaced apart and generally parallel second vertical rib 82. The first rib 80 includes a first lower surface 84 that is complementarily-shaped with the base fishing surface 52 of the rail 24 and that is adapted to engage the base fishing surface 52. The first rib 80 also includes a first upper surface 86 which is complementarily-shaped with the head fishing surface 62 of the rail 24 and that is adapted to engage the head fishing surface 62. The first rib 80 also includes a rear surface 88 that extends between the first lower surface 84 and the first upper surface 86. The rear surface 88 includes a concave surface portion 90 adjacent to the first lower surface 84.

The second rib 82 includes a second lower surface portion 94 that is complementarily-shaped with the base fishing surface 52 of the rail 24 and that is adapted to engage the base fishing surface 52. The second rib 82 also includes a second upper surface 96 that is complementarily-shaped with the head fishing surface 62 of the rail 24 and that is adapted to engage the head fishing surface 62. The second rib 82 also includes a rear surface 98 that extends between the second lower surface 94 and the second upper surface 96. The rear surface 98 includes a concave surface portion 100 located adjacent to the second lower surface 94. A recess 102 is formed in the body 72 between the first rib 80 and the second rib 82. An upper surface 104 extends between the upper surfaces 86 and 96. The upper surface 104 is complementarily-shaped with the head fishing surface 62 of the rail 24, and is adapted to engage the head fishing surface 62.

The body 72 of the brace member 70 also includes a generally planar and vertical front surface 106 and an inclined front friction surface 108 that extends upwardly and inwardly from the front surface 106. The front friction surface 108 is preferably disposed at a vertical angle of forty-five degrees or greater from the horizontal, and preferably at a vertical angle of approximately fifty-four degrees from horizontal. In addition to being inclined at a vertical angle from horizontal, the front friction surface 108 is disposed at a horizontal angle to the longitudinal axis 78 of the body 72 equal to the angle at which the angled side wall 36 of the rail seat 26 is disposed to the side wall 34 and to the central axis of the rail 24, which is preferably approximately 4.8°. The front friction surface 108 comprises a corrugated surface having a plurality of generally parallel and evenly spaced apart elongate linear ridges 110. Each ridge 110 includes first and second generally planar surfaces that are inclined and that intersect at a peak 112. A valley 114 is located between each adjacent pair of peaks 112.

The brace member 70 also includes a toe member 120 that is at the bottom end of the body 72 and which extends outwardly from the body 72. The toe member 120 includes a bottom surface 122 which is adapted to be disposed adjacent to the bottom wall 28 of the rail seat 26. The toe member 120 also includes a generally planar and vertical front engagement surface 124 and a generally planar and horizontal upper engagement surface 126 which extends from the top of the front engagement surface 124 to the bottom of the front surface 106 of the body 72. The front engagement surface 124 is disposed at a horizontal angle to the axis 78 of the body 72 which is equal to the angle at which the side wall 36 of the rail seat 26 is disposed to the side wall 34 of the rail seat 26 and to the central axis 64 of the rail 24. The brace member 70 is preferably formed from ductile iron.

Figure 9:
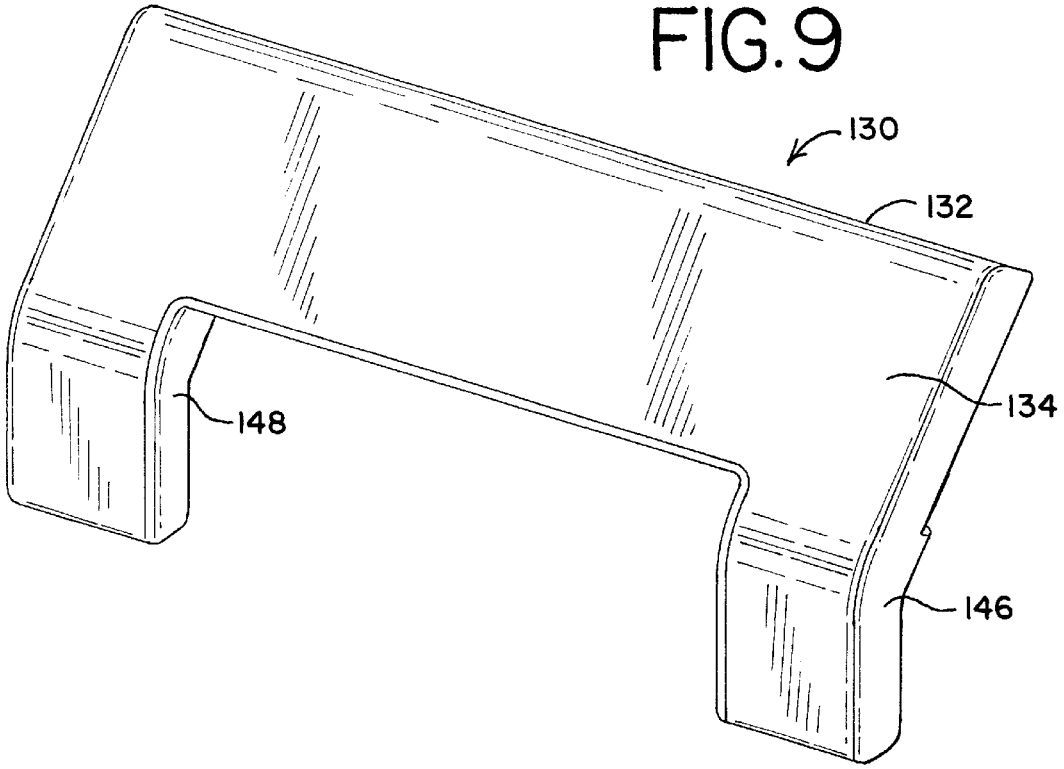
FIG. 9 is a front perspective view of the locking member of the rail brace assembly.
Figure 10:
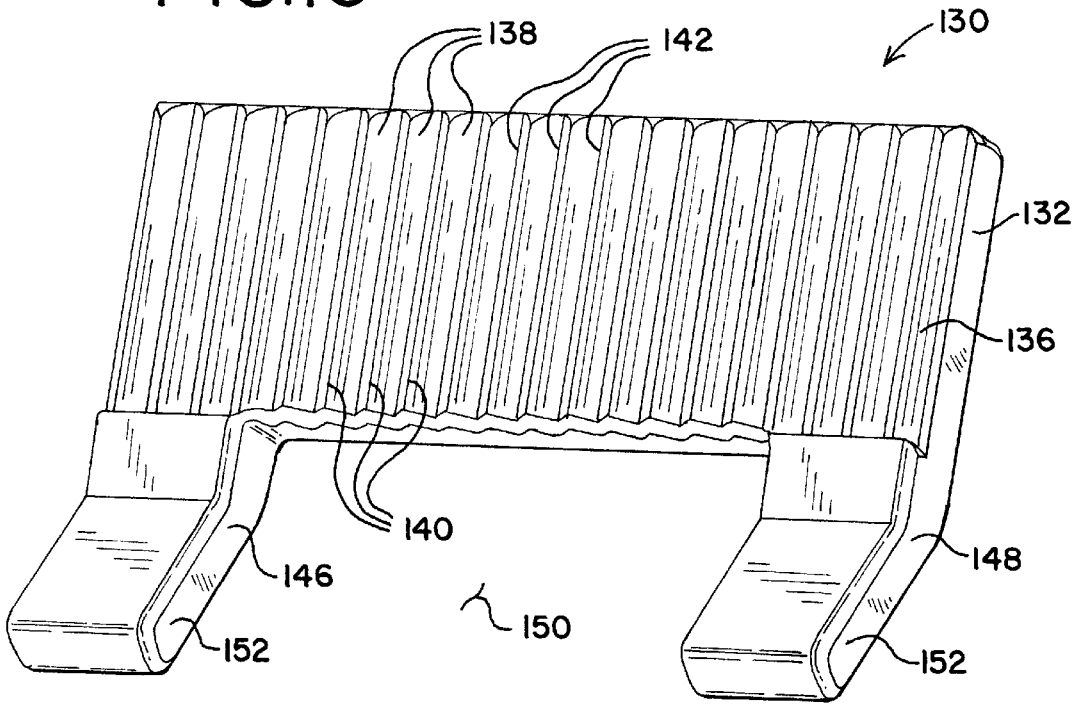
FIG. 10 is a rear perspective view of the locking member.
Figure 11:
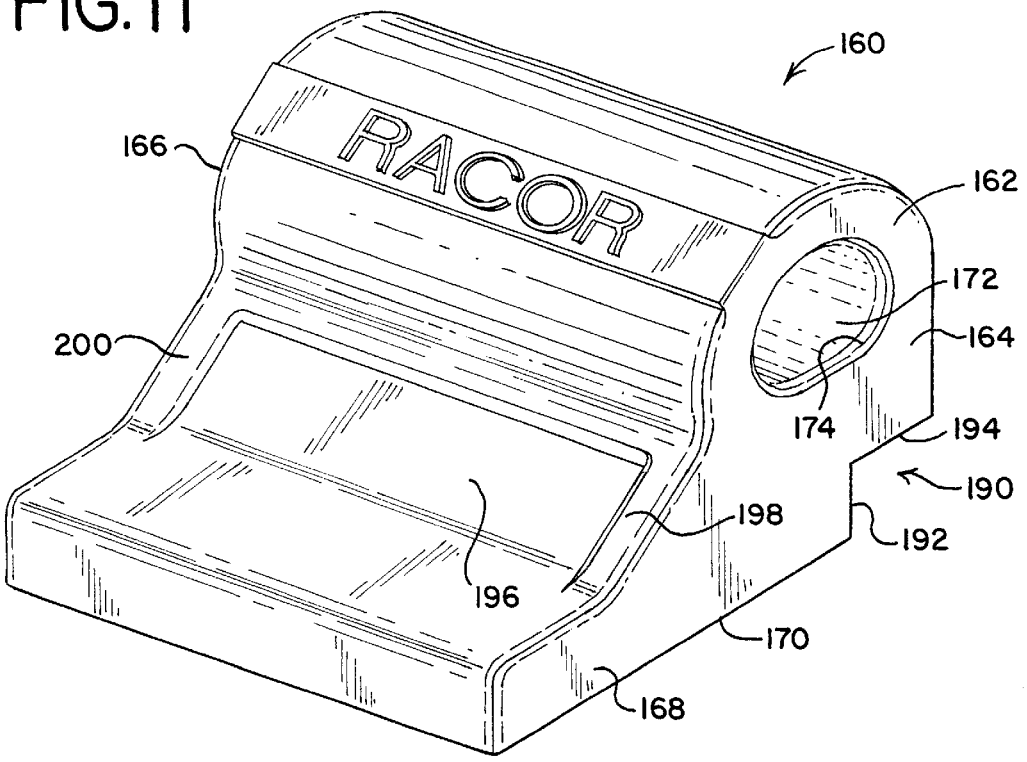
FIG. 11 is a front perspective view of the retention member of the rail brace assembly.
Figure 12:
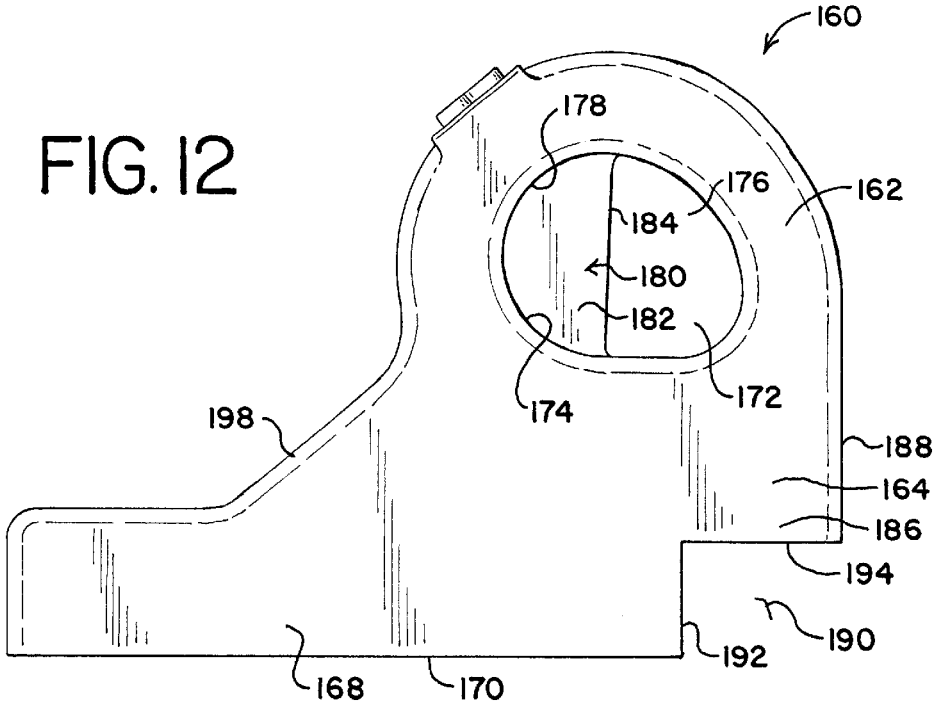
FIG. 12 is a side view of the retention member.
Figure 13:
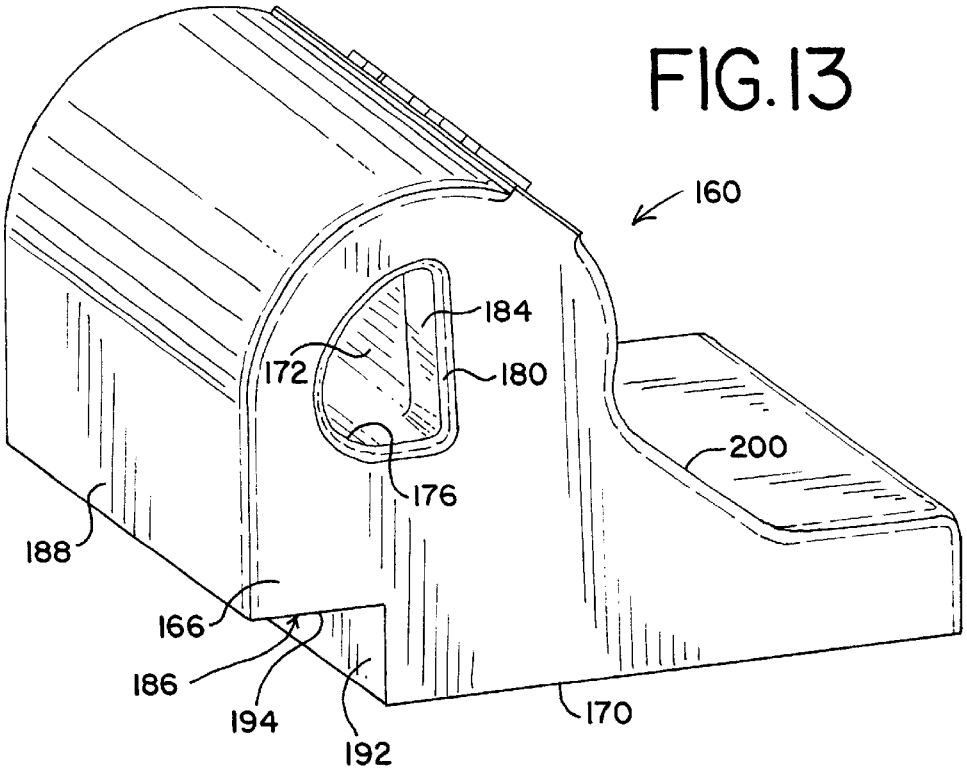
FIG. 13 is a rear perspective view of the retention member.
Figure 14:
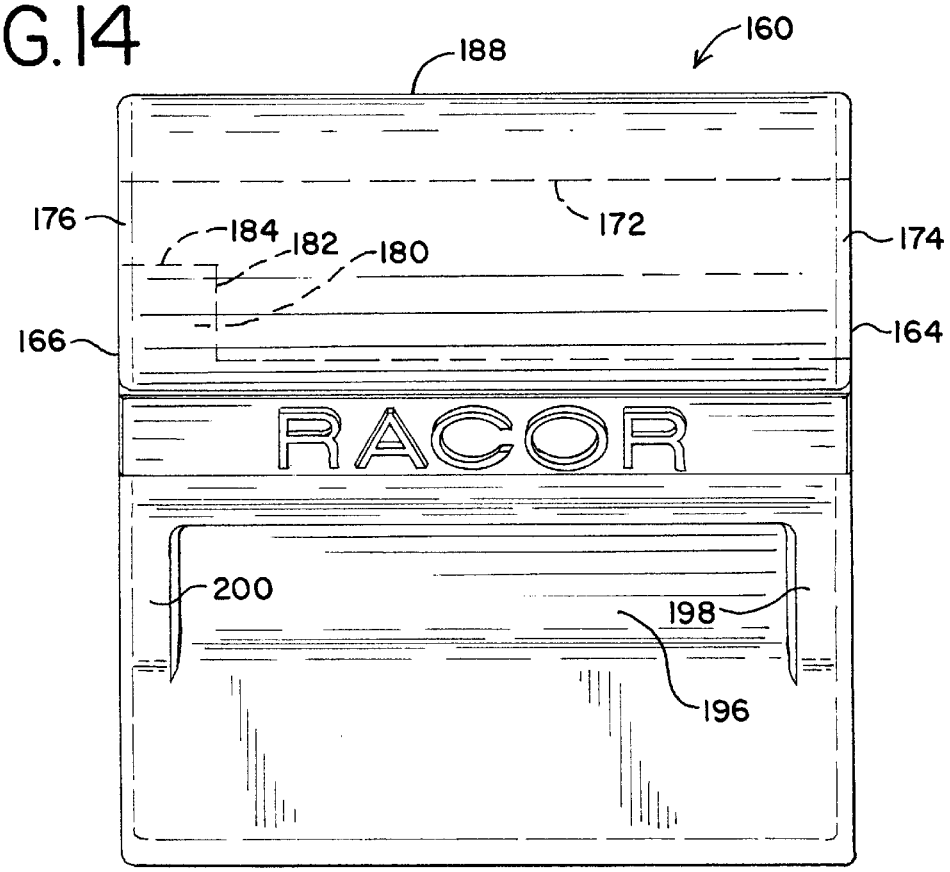
FIG. 14 is a top plan view of the retention member.

The rail brace assembly 20 also includes a locking member 130 as best shown in FIGS. 9 and 10. The locking member 130 includes a generally rectangular body 132 having a generally planar front surface 134 and a rear friction surface 136. The rear friction surface 136 is a corrugated surface that includes a plurality of generally parallel and evenly spaced apart elongate linear ridges 138. Each ridge 138 includes first and second generally planar surfaces that are inclined and that intersect at a peak 140. A valley 142 is located between each adjacent pair of peaks 140. Each ridge 138 and peak 140 of the rear friction surface 136 of the locking member 130 is adapted to be located within a valley 114 between two peaks 112 of the front friction surface 108 of the brace member 70. Similarly, each ridge 110 and peak 112 of the front friction surface 108 of the brace member 70 is adapted to be located within a valley 142 of the rear friction surface 136 of the locking member 130. The rear friction surface 136 of the locking member 130 thereby interlocks with the front friction surface 108 of the brace member 70 to inhibit lateral movement of the brace member 70 with respect to the locking member 130 in a direction generally parallel to the axis 78. As shown in FIGS. 5 and 10, the ridges 110 of the front friction surface 108 are spaced farther apart than are the ridges 138 of the rear friction surface 136, such that a ridge 110 of the front friction surface 108 of the brace member 70 will not be located within every valley 142 of the rear friction surface 136 of the locking member 130.

The locking member 130 also includes a first leg 146 that extends outwardly and downwardly from the bottom end of the body 132 and a second leg 148 that extends outwardly and downwardly from the bottom end of the body 132. The legs 146 and 148 are spaced apart and generally parallel to one another. A gap 150 is formed between the legs 146 and 148. Each leg 146 and 148 includes a foot 152 that is disposed at an angle to the body 132 of the locking member 130.

The rail brace assembly 20 also includes a retention member 160 as best shown in FIGS. 11–14. The retention member 160 includes a body 162 having a first side wall 164 at a first end and a second side wall 166 at a second end. The body 162 includes a base 168 which is adapted to be attached to the top surface of the tic plate 22 by welding or the like. The base 168 includes a bottom surface 170 which is adapted to be located on the top surface of the tie plate 22. The body 162 includes a bore 172 which extends from the first side wall 164 to the second side wall 166. The bore 172 includes a first aperture 174 located in the first side wall 164 and a second aperture 176 located in the second side wall 166. The bore 172 includes a circumferential side wall 178 which is generally egg-shaped in configuration. The body 162 includes a stop member in the form of a wall 180 which projects inwardly from a portion of the side wall 178 into the bore 172. The wall 180 includes a generally planar inner surface 182 which is generally perpendicular to the longitudinal axis of the bore 172, and an end surface 184 which extends generally diametrically across the bore 172. The wall 180 defines the second aperture 176. The second aperture 176 has a smaller area than the first aperture 174.

The retention member 160 also includes a vertical engagement member 186 having generally planar and vertical rear surface 188. The engagement member 186 forms a recess in the form of an elongated groove 190 which extends from the first side wall 164 to the second side wall 166. The groove 190 forms a generally planar and vertical side wall surface 192 which extends upwardly from the bottom surface 170. The engagement member 186 includes a generally planar wall surface 194 which extends generally horizontally from the top end of the side wall surface 192 to the bottom end of the rear surface 188. The groove 190 is adapted to receive the toe member 120 of the brace member 70. The retention member 160 also includes an inclined front surface 196 that extends between a first raised portion 198 located adjacent the first side wall 164 and a second raised portion 200 located adjacent the second side wall 166. The retention member 160 is preferably formed from cast steel.

The rail brace assembly 20 also includes a resilient fastener such as a spring clip member 208 as best shown in FIG. 4. The spring clip 208 includes a first leg 210 at a first end and a second leg 212 at a second end. The legs 210 and 212 are spaced apart and generally parallel to one another. A body portion 214 extends between the first leg 210 and the second leg 212. The spring clip 208 is formed from steel and is resiliently flexible. The first leg 210 of the spring clip 208 is adapted to be inserted into the bore 172 of the retention member 160 through the first aperture 174. The second leg 212 of the spring clip 208 is adapted to engage the front surface 134 of the locking member 130 and to exert a resilient biasing force against the front surface 134. The body portion 214 of the spring clip 208 is adapted to engage the inclined front surface 196 of the retention member 160. The spring clip 208 is a commonly available commercial item.

In operation, the base 46 of the rail 24 is located on the bottom wall 28 of the rail seat 26 such that the flange 50 is in abutting engagement with the side wall 34 of the rail seat 26. The retention member 160 is attached to the top surface of the tie plate 22 such that the side wall surface 192 of the groove 190 is generally parallel to the angled side wall 36 of the rail seat 26 and is thereby disposed at a horizontal angle to the longitudinal axis 78 of the brace member 70 and to the longitudinal axis 64 of the rail 24. The side wall surface 192 of the groove 190 is preferably generally coplanar with the angled side wall 36, or spaced slightly inwardly from the angled side wall 36 of the rail seat 26.

The brace member 70 is placed in engagement with the rail 24 such that the lower surfaces 84 and 94 are in engagement with the base fishing surface 52 of the rail 24, and such that the upper surfaces 86, 96 and 104 are in engagement with the head fishing surface 62 of the rail 24. The toe member 120 of the brace member 70 is located in the rail seat 26 between the outer end of the first flange 48 of the rail 24 and the angled side wall 36 of the rail seat 26, and within the recess 190 of the retention member 160. The brace member 70 is moved laterally in a direction generally parallel to the longitudinal axis 78, and generally parallel to the central axis 64 of the rail 24, until the front engagement surface 124 of the toe member 120 matingly engages the side wall surface 192 of the groove 190 in the retention member 160 and the angled side wall 36 of the rail seat 26. The brace member 70 is then forcefully moved by a sledge hammer, hydraulic cylinder or the like further in a lateral direction toward the second edge 32 of the rail seat 26, such that the brace member 70 is wedged between the retention member 160 and the rail 24 with the toe member 120 being wedged within the groove 190 of the retention member 160. The concave surface portions 90 of the ribs 80 and 82 of the brace member 70 provide a large gap with the rail 24 to allow for the positioning of a switch heater rod against the rail 24.

The locking member 130 is then located in position such that the body 162 of the retention member 160 is located within the gap 150 and between the legs 146 and 148 of the locking member 130, such that the first leg 146 is located adjacent the first side wall 164 of the retention member 160 and such that the second leg 148 is located adjacent the second side wall 166 of the retention member 160. The rear friction surface 136 of the locking member 130 is placed in interlocking engagement with the front friction surface 108 of the brace member 70 such that the ridges 110 of the front friction surface 108 of the brace member 70 are each located within a valley 142 in the rear friction surface 136 of the locking member 130. The ends of the legs 146 and 148 of the locking member 130 engage the upper engagement surface 126 of the toe member 120 of the brace member 70.

The first leg 210 of the spring clip 208 is then inserted into the bore 172 of the retention member 160 through the first aperture 174. The first leg 210 is inserted until the end of the first leg 210 engages the inner surface 182 of the stop wall 180. The stop wall 180 thereby prevents the first leg 210 of the spring clip 208 from being inserted into the bore 172 beyond a predetermined distance. The body portion 214 of the spring clip 208 engages the inclined front surface 196 of the retention member 160, and the second leg 212 of the spring clip 208 is in biased engagement with the front surface 134 of the locking member 130. The second leg 212 of the spring clip 208 thereby resiliently biases the rear friction surface 136 of the locking member 130 into interlocking engagement with the front friction surface 108 of the brace member 70. The spring clip 208 can be selectively removed from the retention member 160 to disassemble the locking member 130 and brace member 70. The stop wall 180 of the retention member 160 prevents the first leg 210 of the spring clip 208 from being over inserted into the bore 172 of the retention member 160. Over insertion of the spring clip 208 into the bore of a retention member 160 can cause the spring clip 208 to eventually fail from fatigue.

As the legs 146 and 148 of the locking member 130 straddle the retention member 160, the legs 146 and 148 prevent lateral movement of the locking member 130 with respect to the retention member 160. The biased interlocking engagement between the rear friction surface 136 of the locking member 130 and the front friction surface 108 of the brace member 70 inhibits lateral movement of the brace member 70, in a direction generally parallel to the axes 64 and 78, with respect to the locking member 130 and thereby with respect to the retention member 160 and the rail 24. The second leg 212 of the spring clip 208 applies a resilient biasing force to the locking member 130 and thereby to the brace member 70 which biases the lower surfaces 84 and 94 into engagement with the base fishing surface 52 of the rail 24, and which biases the upper surfaces 86, 96 and 104 into engagement with the head fishing surface 62 of the rail 24. As the front friction surface 108 of the brace member 70 is disposed at a vertical angle of forty-five degrees or greater to horizontal, the biasing force applied by the spring clip 208 to the brace member 70 has a horizontal force component which is equal to or greater than the downward vertical force component of the biasing force. The brace member 70 thereby inhibits transverse and rotational movement of the rail 24.

The toe member 120 of the brace member 70 is disposed within the groove 190 of the retention member 160 such that the upper engagement surface 126 of the toe member 120 is positioned to provide minimal clearance with respect to the wall surface 194 of the engagement member 186. The upper surface of the toe member 120 is adapted to engage the wall surface 194 of the engagement member. The wall surface 194 of the retention member 160 thereby inhibits or prevents upward vertical movement of the brace member 70 due to the mechanical interlocking of the toe member 120 with the engagement member 186 of the retention member 160. The brace member 70 thereby inhibits upward vertical movement of the rail 24. The rail brace assembly 20 thereby braces the rail 24 against transverse movement of the rail 24 toward the angled side wall 36 of the rail seat 26, rotational movement of the rail 24, and vertical movement of the rail 24 with respect to the tie plate 22.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. A rail brace assembly for bracing a rail with respect to a tie plate, the rail having a head fishing surface and a base fishing surface, said rail brace assembly including:

a brace member having a top surface adapted to engage the head fishing surface of the rail, a bottom surface adapted to engage the base fishing surface of the rail, a front friction surface, and an outwardly extending toe;

a retention member adapted to be attached to the tie plate, said retention member including an engagement member adapted to engage said toe of said brace member and a bore having a first aperture;

a locking member adapted to engage said retention member, said locking member having a rear friction surface, said rear friction surface adapted to engage said front friction surface of said brace member; and a resilient fastener having a first end adapted to be inserted into said bore through said first aperture, and a second end adapted to engage said locking member such that said fastener resiliently biases said rear friction surface of said locking member into engagement with said front friction surface of said brace member such that said locking member inhibits lateral movement of said brace member, whereby said top surface and said bottom surface of said brace member are adapted to inhibit movement of the rail and said retention member is adapted to engage said toe of said brace member to inhibit vertical movement of said brace member and of the rail.

2. The rail brace assembly of claim 1 wherein said front friction surface of said brace member and said rear friction surface of said locking member each include a plurality of peaks.

3. The rail brace assembly of claim 1 wherein said front friction surface of said brace member and said rear friction member of said locking member each include a plurality of generally linear ridges.

4. The rail brace assembly of claim 1 wherein said front friction surface of said brace member and said rear friction surface of said locking member each comprise a respective corrugated surface.

5. The rail brace assembly of claim 1 wherein said front friction surface of said brace member is inclined at an angle of at least forty-five degrees from horizontal.

6. The rail brace assembly of claim 1 wherein said brace member includes a front surface adapted to engage said retention member.

7. The rail brace assembly of claim 6 wherein said brace member includes a longitudinal axis and said front surface of said brace member is disposed at an angle to said longitudinal axis.

8. The rail brace assembly of claim 1 wherein said toe of said brace member includes an upper surface adapted to engage said retention member.

9. The rail brace assembly of claim 1 wherein said locking member includes a first outwardly extending leg adapted to engage said retention member to thereby substantially prevent lateral movement of said locking member in said first lateral direction.

10. The rail brace assembly of claim 9 wherein said locking member includes a second outwardly extending leg spaced apart from said first leg, said first leg and said second leg adapted to be located on opposite sides of said retention member to substantially prevent lateral movement of said locking member with respect to said retention member.

11. The rail brace assembly of claim 1 wherein said retention member includes a stop member adapted to engage said first end of said fastener when said first end of said fastener is inserted into said bore of said retention member and thereby prevent further insertion of said first end of said fastener into said bore.

12. The rail brace assembly of claim 11 wherein said stop member comprises a wall.

13. The rail brace assembly of claim 12 wherein said wall forms a second aperture in communication with said bore such that said bore extends through said retention member.

14. The rail brace assembly of claim 1 wherein said retention member includes a recess adapted to receive said toe of said brace member.

15. The rail brace assembly of claim 1 wherein said engagement member includes a surface adapted to engage said toe of said brace member.

16. The rail brace assembly of claim 1 wherein said fastener comprises a spring clip having a first leg and a second leg, said first leg adapted to be inserted into said bore of said retention member and said second leg adapted to engage said front surface of said locking member.

17. The rail brace assembly of claim 14 wherein said recess of said retention member comprises an elongate groove.

18. The rail brace assembly of claim 17 wherein said recess includes a side surface adapted to engage said toe of said brace member.

19. A brace member adapted for use with a retention member for bracing a rail having a head fishing surface and a base fishing surface, said brace member including:

a body having a first end and a second end, a longitudinal axis extending from said first end to said second end, a first rib and a spaced apart second rib, said first rib including a first upper surface adapted to engage the head fishing surface of the rail and a first lower surface adapted to engage the base fishing surface of the rail, said second rib including a second upper surface adapted to engage the head fishing surface of the rail and a second lower surface adapted to engage the base fishing surface of the rail, and a front friction surface adapted to inhibit lateral movement of said brace member along said longitudinal axis; and a toe extending outwardly from said body, said toe having an upper engagement surface adapted to engage the retention member.

20. The brace member of claim 19 wherein said toe includes a front engagement surface disposed at an angle to said longitudinal axis of said body.

21. The brace member of claim 19 wherein said friction surface is inclined at a vertical angle to horizontal and is disposed at a horizontal angle to said longitudinal axis of said body.

22. The brace member of claim 19 wherein said friction surface includes a plurality of peaks.

23. The brace member of claim 19 wherein said friction surface includes a plurality of elongate ridges.

24. The brace member of claim 19 wherein said friction surface comprises a corrugated surface.

25. The rail brace assembly of claim 19 wherein each said rib includes a concave surface portion located between said upper surface portion and said lower surface portion of said rib.

26. A locking member adapted for use with a retention member and a brace member for bracing a rail, said locking member including:

a body having a front surface and a rear friction surface adapted to engage the brace member;

a first leg extending outwardly from said body; and a second leg extending outwardly from said body, said second leg being spaced apart from said first leg, said first and second legs adapted to be respectively located on opposite sides of the retention member such that said first and second legs substantially prevent lateral movement of said locking member with respect to the retention member.

27. The locking member of claim 26 wherein said friction surface includes a plurality of peaks.

28. The locking member of claim 26 wherein said friction surface includes a plurality of elongate ridges.

29. The locking member of claim 26 wherein said friction surface comprises a corrugated surface.

30. The locking member of claim 26 wherein each said leg includes a foot disposed at an angle to said body.

31. A rail retention member for use with a spring clip having a first leg in securing a rail to a tie plate, said rail retention member including:

a body having a first end and a second end, a base adapted to be attached to the tie plate, a bore extending into said body adapted to receive the first leg of the spring clip, said bore including a first aperture located in said first end of said body such that the first leg of the spring clip is insertable into said bore through said first aperture, and a stop memberadapted to engage the first leg of the spring clip and preventt insertion of the first leg of the spring clip into said bore beyond a predetermined distance.

32. The rail retention member of claim 31 wherein said stop member comprises a wall.

33. The rail retention member of claim 32 wherein said wall defines a second aperture in communication with said bore.

34. The rail retention member of claim 33 wherein said bore extends from said first end to said second end of said body.

35. The rail retention member of claim 33 wherein said second aperture is located at said second end of said body.

36. The rail retention member of claim 31 including a recess formed in said body adapted to receive a rail brace.

37. The rail retention member of claim 36 wherein said recess comprises an elongate groove.

38. The rail retention member of claim 36 wherein said recess includes an upper wall surface adapted to engage the rail brace and a side wall surface adapted to engage the rail brace.

39. The rail retention member of claim 31 including an engagement member adapted to engage the rail brace.

* * * * *